US005339915A

United States Patent [19]

Laporte et al.

[11] Patent Number: 5,339,915

[45] Date of Patent: Aug. 23, 1994

[54] DRILLING APPARATUS, PARTICULARLY WIRE LINE CORE DRILLING APPARATUS

[75] Inventors: Irwin J. Laporte; Amos J. Watkins, both of North Bay, Canada

[73] Assignee: JKS Boyles International, Inc., Orillia, Canada

[21] Appl. No.: 962,408

[22] Filed: Oct. 16, 1992

[30] Foreign Application Priority Data

Oct. 18, 1991 [CA] Canada ..... 2503719

[51] Int. Cl.[5] ..... E21B 10/64

[52] U.S. Cl. ..... 175/244

[58] Field of Search ..... 166/236, 239, 244, 246–250

[56] References Cited

U.S. PATENT DOCUMENTS 3,333,647 8/1967 Karich et al. .
3,667,558 6/1972 Lambot .
4,800,969 1/1989 Thompson .
4,834,198 5/1989 Thompson ..... 175/244 X

FOREIGN PATENT DOCUMENTS 673425 11/1963 Canada .
716453 8/1965 Canada .
754453 3/1967 Canada .
757502 4/1967 Canada .
948621 6/1974 Canada .
967142 5/1975 Canada .
968781 6/1975 Canada .
977329 11/1975 Canada .
983008 2/1976 Canada .
984825 3/1976 Canada .
1014944 8/1977 Canada .
1128493 7/1982 Canada .
1169414 6/1984 Canada .

*Primary Examiner*—Thuy M. Bui
*Attorney, Agent, or Firm*—Leonard Bloom

[57] ABSTRACT

This invention relates to a wire line core barrel inner tube assembly capable of travelling longitudinally within a drill string toward and away from a drill bit carried on the lower end of the string, the drill string having an annular landing shoulder therein. The inner tube assembly includes an elongated body having an annular landing shoulder adapted to co-operate with and seat on the landing shoulder of the drill string when in use. The body has a valve chamber defined therein and inlet and outlet ports leading from the valve chamber to the exterior of the body on opposite sides of the landing shoulder. These define a by-pass passage through which drilling liquid passing along the drill string must flow on its way toward the bit when the landing shoulder of said body is seated on the landing shoulder of the drill string. The valve chamber has a valve seat therein and a valve closure is located within the valve chamber. A biasing device urges the valve closure against the valve seat with a selected pre-loading force as to prevent flow of drilling liquid through the by-pass passage and toward the drill bit until the pressure differential across the valve closure is increased to a level sufficient to overcome the pre-loading force applied by the biasing device.

18 Claims, 3 Drawing Sheets

DRILLING APPARATUS, PARTICULARLY WIRE LINE CORE DRILLING APPARATUS

BACKGROUND OF THE INVENTION

This invention relates to the art of drilling and in particular it relates to wire line core drilling apparatus.

In the course of wire-line drilling, the core barrel inner tube assembly is dropped or pumped along the bore of a drill string to a position just above or behind the drill bit. The drill string is provided with an annular landing shoulder therein. The inner tube assembly is also provided with a landing shoulder which is adapted to co-operate with and seat on the landing shoulder of the drill string. The inner tube assembly is provided with spring loaded latches which automatically move outwardly and engage in an annular recess, termed the latch seat, which is provided in the lower section of the drill string (otherwise known as the outer tube) thereby to anchor the inner tube assembly against axial movement in the bore. A drilling liquid, typically water, is pumped along the drill string thereby to propel the inner tube assembly along to the landing position which is of course correctly positioned relative to the drill bit.

The primary objective of a core drilling operation is to obtain a core of drilled material for purposes of geological analysis. The lower end of the drill string is accordingly provided with an annular drill bit of any desired well known variety, the bit having diamonds or boart embedded therein to enable the bit to cut through the hardest formations likely to be encountered. As the drilling proceeds, the rotating bit cuts through the formations and a core of the formation being drilled rises upwardly into and is captured by the core receiving barrel of the inner tube assembly. When the core barrel is filled, the drilling operator on the surface lowers an overshot assembly down the drill string by way of a wire line. The overshot assembly is arranged to engage with the upper end of the inner tube assembly and the wire line is then hoisted upwardly, in the course of which the spring loaded latches release thus allowing the inner tube assembly to be hoisted to the surface. The core of material, which has broken off from the formation, is captured within the inner tube assembly in well known fashion and when the inner tube assembly reaches the surface the core is removed and taken away for analysis. Following this, the inner tube assembly is then lowered down the drill string in preparation for the taking of a further sample. The movement is usually assisted by a flow of drilling liquid, i.e. water, this flow of water being provided by a flush pump which is capable of producing the flow rates and pressures required during the course of a drilling operation.

During the course of a normal core drilling operation, the above-noted pump forces the drilling liquid down the drill string, through and along the above-noted inner tube assembly, and downwardly to the bit where the liquid cools the bit and flushes away the cuttings therefrom, the fluid velocity being sufficient to lift these cuttings upwardly along the exterior of the drill string and along the drill hole up to the surface. The loss of drilling liquid circulation can give rise to serious problems. Since the liquid cools and lubricates the bit, loss of liquid will soon give rise to overheating and burning out of the bit in consequence of which the entire drill string must be pulled out of the hole. Even worse, loss of circulation may cause the drill string to cease up or jam within the hole owing to a build-up of cuttings between the drill string outer wall and the bore hole surface. (Drilling liquid can be lost when drilling through formations having substantial cracks and crevices. If the crevice is large enough, all of the liquid standing in the drill string and bore hole can be lost. When this happens, the pressure at the surface will drop to 0 and if there is an obstruction in the hole and the drilling liquid cannot pass through the bit because of bad rock conditions, by the time the pressure builds up to indicate this on the fluid gauge, it is likely too late, the bit will be either burned out and/or the drilling string will be stuck.) Removal of a stuck drill string can be a difficult operation and in serious cases the hole can be lost altogether.

Another problem with the system described above is that the drill operator on the surface often has difficulty determining when the latches are properly engaged in the latch seat. If the inner tube assembly is not properly landed on the landing rings and latched, and drilling is allowed to proceed, a great deal of time may be lost because the core then cannot be retrieved by means of the wire line system. The drill string must be moved from the hole and a fishing operation may be necessary to recover the core. At best, the core which is obtained is likely to be broken and unsuitable for an accurate analysis of same to be made.

In the past, the operator has used various inaccurate techniques to estimate when the inner tube assembly has landed and latched in position. A good operator should be able to listen to the descending assembly and may be able to hear the latches click into position. Other operators try to estimate when the correct position on the inner tube assembly has been reached merely by timing the descent of the assembly within the drill string. For these techniques to work, very experienced drillers are required and even then, problems are often encountered. An experienced driller will not have a sufficient "feel" for the situation and the resulting guess work can give rise to lengthy and costly delays.

SUMMARY OF THE INVENTION

It is a primary object of the present invention to provide improvements in drilling equipment of the type discussed above, which improvements alleviate problems associated with improper latching as well as burning of bits and drill string sticking resulting from loss of drilling liquid circulation.

One aspect of the invention provides a wire line core barrel inner tube assembly capable of travelling longitudinally within a drill string toward and away from a drill bit carried on the lower end of the string, the drill string having an annular landing shoulder therein. The inner tube assembly includes an elongated body having an annular landing shoulder adapted to co-operate with and seat on the landing shoulder of the drill string when in use. The body has a valve chamber defined therein and inlet and outlet ports leading from the valve chamber to the exterior of the body on opposite sides of the landing shoulder. These define a by-pass passage through which drilling liquid passing along the drill string must flow on its way toward the bit when the landing shoulder of said body is seated on the landing shoulder of the drill string. The valve chamber has a valve seat therein and a valve closure is located within the valve chamber. A biasing device urges the valve closure against the valve seat with a selected pre-loading force as to prevent flow of drilling liquid through the by-pass passage and toward the drill bit until the pressure differential across the valve closure is increased to a level sufficient to overcome the pre-loading force applied by the biasing device.

In a further aspect said biasing device is arranged so that the differential pressure needed to open the closure is sufficient so that in the event the bit strikes a cavity or crevice in a formation being drilled resulting in loss of drilling liquid, at least a substantial head of drilling liquid will be retained in the drill string thereby to alleviate burning of the bit and sticking of the drill string owing to loss of drilling liquid circulation.

Further in accordance with the invention, the body is a latch body carrying spring-loaded latches arranged to engage a latch seat in the drill string when the inner tube assembly reaches a fully landed position in the drill string with the landing shoulder of said body seated on the drill string landing shoulder. The biasing device is arranged so that the differential pressure necessary to overcome the pre-loading force causes a pressure rise at the surface detectable by a driller as soon as the fully landed condition is attained in consequence of which the driller knows that landing and latching have been achieved.

The above-noted biasing device is arranged such that the differential pressure necessary to overcome the pre-loading force applied is not less than about 50 p.s.i. In many, if not most situations, the differential pressure necessary will be much greater, possibly not less than 100 p.s.i. The uppermost limit is not anticipated to be greater than 500 p.s.i.

In a preferred form of the invention, the valve closure comprises a ball and the biasing device comprises a coil compression spring. The spring is preferably mounted on and disposed about a threaded adjustment rod, the distal end of the rod serving as a stop to limit the degree of travel of the ball between full open and full closed positions and rotation of the rod serving to advance the rod axially toward and away from the valve seat to vary the pre-loading force.

In a further aspect of the invention there is provided a latch body for wire line core barrel inner tube assembly, the latch body having the characteristics set out in certain claims appended hereto.

A further aspect of the invention provides an improved core drilling method as set out in certain claims appended hereto.

It is contemplated that the principles of the invention may also find application in other wider fields of drilling operations as set forth in certain claims appended hereto.

The various features and advantages of the present invention will be better understood from the following description of a preferred embodiment of same, reference being had to the appended drawings as well as the appended claims.

BRIEF DESCRIPTION OF THE VIEWS OF DRAWINGS

The invention will now be described in more detail by way of example only with reference to the accompanying drawings in which.

DETAILED DESCRIPTION OF THE PREFERRED EMBODIMENT

Figure 1:
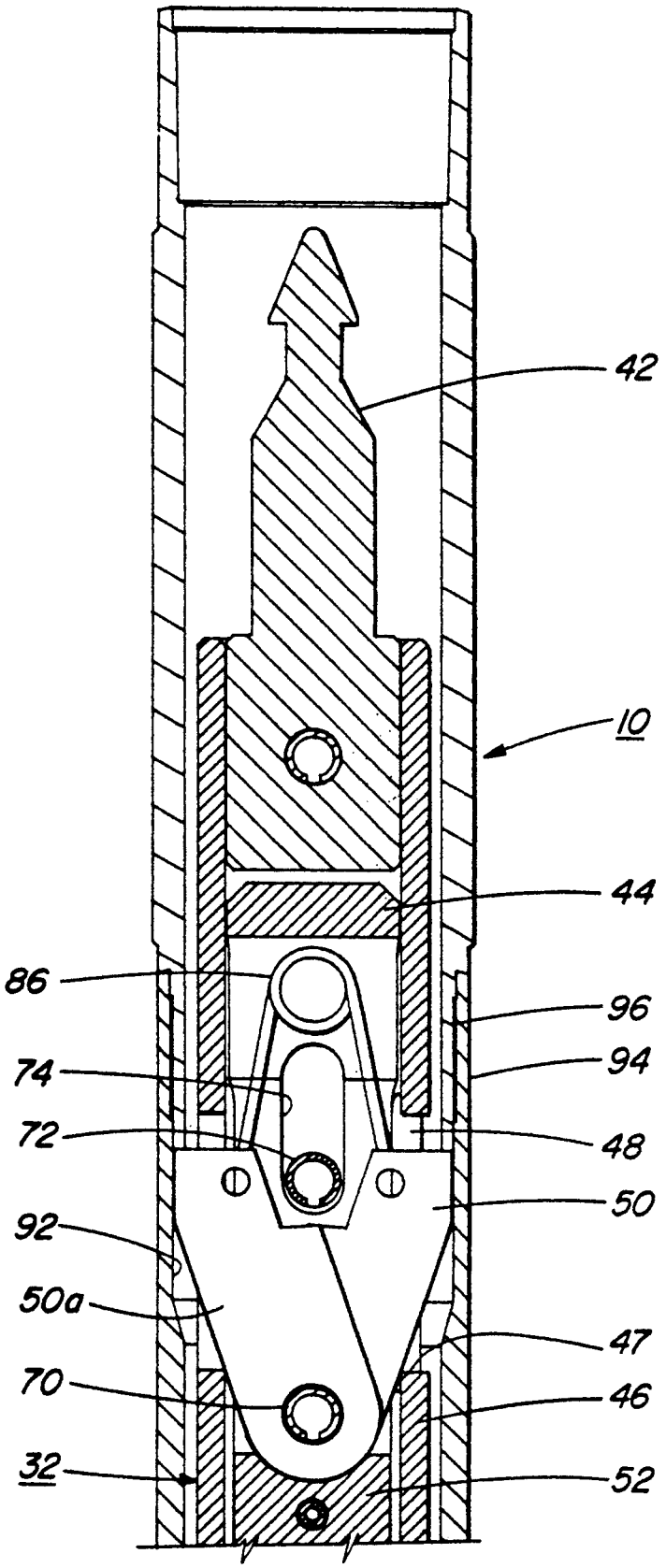
FIG. 1 is a longitudinal section view taken through the upper part of a core barrel assembly in accordance with the invention.
Figure 2:
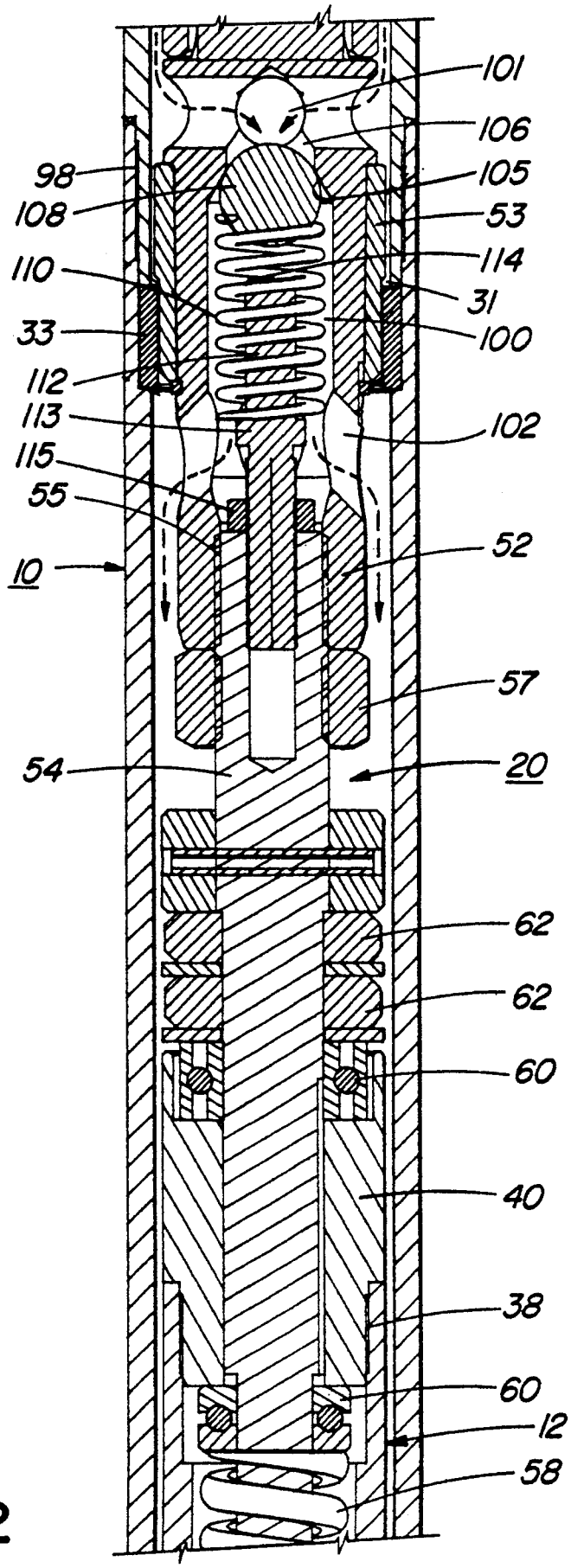
FIG. 2 is a longitudinal section through an intermediate portion of the core barrel assembly.
Figure 3:
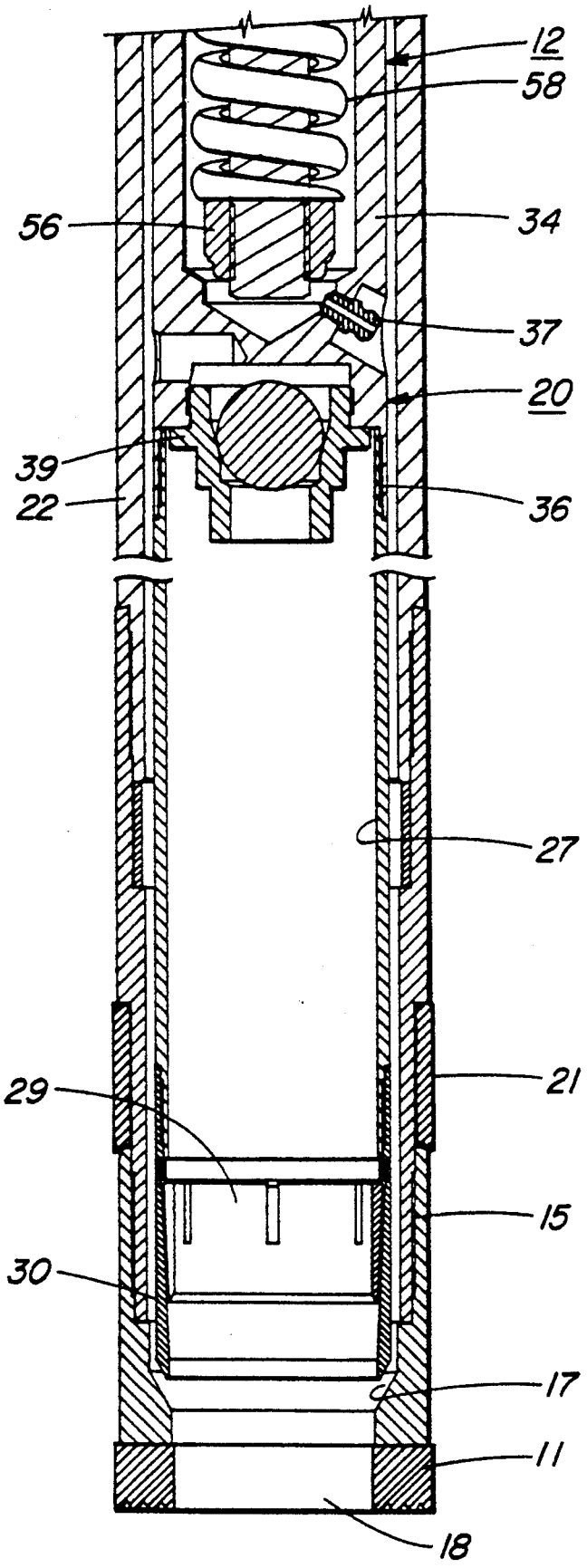
FIG. 3 is a section view similar to that of FIGS. 1 and 2 but illustrating the lower portion of the core barrel assembly.

With reference to the drawings, there is illustrated one embodiment of the invention which includes a hollow drill string 10 made up of sections of pipe suitably threaded at their opposing ends for coupling same together with a drill bit 11 being located at the lowermost end thereof. In the art, the drill tubes are commonly designated as the "drill string". Thus the term "drill string" will be used herein. The drill string 10 is hollow and disposed within it at its lower end is a core barrel inner tube assembly generally designated by the numeral 12. The head end assembly 32 is connected to the upper end of the lower tube assembly 20 in which the core is received and will be described in further detail hereinafter. The head end assembly 32 together with the lower tube assembly 20 together form the complete core barrel inner tube assembly.

As mentioned above, the lowermost end of the drill string 10 carries the drill bit 11 which in the form here illustrated is a so-called diamond core bit. The cutting surfaces of the diamond core bit are surfaced with diamonds embedded in a hard facing material in the manner well known in the art. It is to be understood that the invention is not limited to diamond core bits but is applicable to all types of hollow core bits such as are conventionally used taking core samples.

The cutting face of the drill bit is provided with a central aperture or opening 18 through which the core sample, as it is cut, enters into the lower tube assembly 20. The drill bit 11 is threaded at 15 onto a reaming shell 21 which may have diamonds or other hard materials on its outer surface. The reaming shell 21 serves to ream the drill hole to a true diameter. The reaming shell 21 is in turn mounted by screw threads on the outer tube 22 at the bottom of the drill string 10.

The lower tube assembly 20 fits loosely within the outer tube 22 at the lower end of the drill stem and extends down to a point closely adjacent an inner shoulder 17 formed on the interior of the drill bit 11. However, the lower core-receiving end of the lower tube assembly 20 is held free from contact with shoulder 17 by means to be described hereinafter.

The lower tube assembly 20 includes a core receiving inner tube 27 which is provided at its lower end with a core lifter ring 29 and a core lifter case 30 threaded onto the lower end of the inner tube 27. The core lifter ring 29 is disposed within the core lifter case 30. The core lifter ring 29, as is well known in the art, comprises a resilient split spring steel ring having a series of longitudinal ribs around its inner periphery which are adapted to engage and firmly hold the core sample so as to permit breaking off the core and subsequently holding it from falling out of the lower tube assembly as this assembly is being raised to the surface. As is well known in the art, the lifter ring 29 is tapered on its outer surface and mates with a correspondingly tapered inner surface of the core lifter case 30. Thus, as the lower tube assembly 20 is lifted, the ring 29 moves longitudinally relative to case 30 thus causing the ring 29 to contract and firmly engage the core with the core being thereby pulled and broken free. It is also noted that the inner surface of the core lifter case 30 is provided with a stop ring which limits the degree of upward motion of core lifter 29 relative to the case 30.

Lower tube assembly 20 further includes an inner tube cap 34 threaded to the upper end of inner tube 27 at 36. A grease nipple 37 is conveniently provided for injecting lubricants into the interior of the cap to lubricate bearings to be described hereafter. Inner tube cap 34 extends upwardly and is threadably connected at 38 to a bearing cap 40 which forms part of the head end assembly 32, the lower end of which assembly is received within the upwardly extending part of tube cap 34.

The main components of the head end assembly 32, starting at the upper end of same, are the lifting spear 42 which is located above the upper end of latch body 52, the upper end of which is disposed in a latch case 46 having diametrically opposed slots 48 therein through which opposed latches 50 project. The latch case 46, in turn, is connected to latch body 52 by means to be described hereafter. It is also noted here that the latch body 52 is provided with an exterior ring 53 defining an annular landing shoulder 31 which rests on a hardened landing ring 33 secured in a recess in the outer tube. The landing shoulder 31 and landing ring 33 serve to support the entire inner core barrel assembly in the drill string and allow lifting forces applied to the drill string to be applied to the core barrel assembly when required. The manner in which the above components co-operate with one another will be described in greater detail hereinafter.

The lower end of latch body 52 is threaded at 55 to receive the upper end of an elongated spindle 54 and is secured by lock nut 57, which spindle passes downwardly through the non-rotating bearing cap 40 (the lower end of which carries a conventional one way valve 39 for passage of drilling liquid). The lower end of spindle 54 is threaded to receive a tension adjusting nut 56 which bears against a compression spring 58 which maintains a thrust load on the bearings 60 which bear against the lower and upper ends of the non-rotating bearing cap 40. The bearings 60, as those skilled in the art will readily appreciate, permit free rotation of the head end assembly 32 with the drill string while allowing bearing cap 40 and the entire lower tube assembly 20 to remain non-rotative during a drilling operation. Disposed just above the upper thrust bearing 60 are a pair of thick rubber water shut-off valves 62 having metal washers therebetween. Annular collar 64 secured to spindle 54 by a transverse roll pin counteracts upward thrusts transmitted through the rubber shut-off valves 62.

As is well known in the art, when drilling has proceeded to a point such that the core receiving inner tube 27 is filled with the core, the upper end of the core bears against the by-pass valve assembly on the lower end of the inner tube cap and the upward thrust force is transmitted through the non-rotating bearing cap 40 and compresses the rubber shut-off valves 62 so that their outer peripheries contact the inner surface of the outer casing of the drill string 10 thus cutting off the flow of drilling fluid and causing a rapid rise in pressure which is detected at the surface by suitable means well known in the art. The core can then be broken free by lifting upon the drill string with those forces being transmitted to the head end assembly 32 via the above mentioned shoulder 31 and landing ring 33 and thence through the above described spindle assembly to the lower tube assembly. The lifting action on the inner tube 27 effects contraction of the lifter ring 29, causing it to grip the core to lift and break same free from the earth formation. The core is then free to be lifted upwardly through the drill string as will be described hereinafter.

The head end assembly 32 will now be described in greater detail with particular reference to latch body 52, latch case 46, latches 50, and lifting spear point 42. The upper end of latch body 52 is provided with a pair of spaced upwardly extending lugs through which a latch pivot pin 70 extends. The two scissor-type latches 50 are pivoted at their lower ends on pin 70 and are disposed intermediate the spaced lugs 68. The upper end of latch body 52 (which is mainly disposed in the latch case 46) includes spaced apart legs defining a slot therebetween sufficiently wide as to allow free scissor-type motion of the two latches 50. In order to retract latches 50 into the latch case, the latch case 46 is movable axially relative to the latch body 52 in response to lifting forces on lifting spear 42 connected to the upper end of the latch case. When a lifting force is applied to spear point 42, the latch case 46 is moved axially so that slot ends 47 ride along the outer sloping edges 51 of the latches providing for a positive release action of the latches 50. When the latches are fully retracted into the latch case, further lifting of the lifting spear transmits lifting forces through a-transverse roll pin 72 which travels along slot 74 in the latch body until the upper end thereof is reached with the lifting force being transmitted to the latch body 52 and causing the entire core barrel inner tube assembly 12 to be lifted upwardly. In order to fully extend the latches when lifting forces are released a spring 86 is provided which is connected to both latches and urges them away from one another in conventional fashion.

It will be appreciated that a function of the latches is to transmit the rotary motion of the drill string to the head end assembly 32. To provide for this action, the inner surface of the drill string tube is machined at latch seat region 92 to allow the latches to extend outwardly a substantial distance beyond the outer circumference of the latch case 46. To facilitate this machining operation, the drill string includes a relatively short section 94 in the region of the latches which is threaded to the drill string sections above and below it at threaded joints 96 and 98. The lowermost end of the drill string section just above section 94 includes a short downwardly extending drive lug (not shown) which is located in the machined out latch seat portion 92 referred to above. The latches 50, when extended, are so arranged that the outermost surfaces of same are generally flush with this latch seat portion and thus one of the latches 50 is engaged by the drive lug and a torsional force applied thereto to effect rotation of the head end assembly 32 during drilling. The lower tube assembly 20 of course remains stationary with the drill core, the relative rotation being accommodated by the above-noted bearings 60.

As described above the latch body 52 has the annular landing shoulder 31 adapted to co-operate with and seat on the landing ring 33 of the drill string when the inner tube assembly is correctly landed. The latch body 52 has the above described spring loaded latches 50 mounted therein and adapted to engage the latch seat 92 in the drill string upon correct landing. The latch body 52 also has an elongated valve chamber 100 defined therein. Inlet and outlet ports (101, 102) leading from the valve chamber 100 to the exterior of the latch body 52 on opposite sides of said landing shoulder 31 serve to define a by-pass passage through which drilling liquid passing along the drill string must flow on its way toward the bit 11 during operation when the landing shoulder 31 of the latch body 52 is seated on the landing shoulder defined by ring 33 of the drill string.

The valve chamber 100 has a conical valve seat 105 therein immediately downstream of circular entrance passage 106. A ball valve closure 108 within the valve chamber co-operate with a biasing spring 110 to urge the ball valve closure 108 against the valve seat 105 with a selected pre-loading force. This serves to prevent flow of drilling liquid through the by-pass passage and toward the drill bit until the pressure differential across the valve closure is increased to a level sufficient to overcome the pre-loading force applied by the biasing spring 110.

As noted above, the valve closure comprises a ball 108 while the biasing device comprises a coil compression spring 110. The spring is mounted on and disposed about a threaded adjustment rod 112 mounted in the upper end of spindle 54, the distal free end 114 of the rod serving as a stop to limit the degree of travel of the ball 108 between the full open and full closed positions. Rotation of the rod 112 serves to advance the rod axially toward and away from the valve seat 105 to vary the spring pre-loading force. Rod adjustment nut 113 is accessible via the exit ports 102 and lock nut 115 secures rod 112 in position.

The following example will be of assistance when selecting a suitable coil spring 110. The first step is to determine the pressure at which the valve closure is to begin to open to pass drilling liquid. This is mainly dependent on the length of the hole being drilled. The valve should be capable of supporting a substantial column of water, in the event a large fissure in the rock is encountered, in order to reduce the chances of the bit running dry for a lengthy period of time. If the valve needs to support only a static head of 100 feet, then the selected valve opening pressure can be set at 0.50 p.s.i. More often it will be set higher than that, frequently 100 p.s.i. or more, although pressures greater than 500 p.s.i. are not likely to be needed.

EXAMPLE

The ball valve closure 108 in this example is a 1.0 inch diameter steel ball. The entrance passage 106 to the valve chamber has a diameter of $\frac{7}{8}$ inch so that the fluid pressure acts on the ball in the closed condition over an area of 0.60 square inches approximately. The required spring pre-loadings for various pre-selected opening pressures can be readily calculated. The characteristics of several chrome-vanadium die springs were investigated and are set out below. The springs characteristics were taken from the "Producto" catalogue and the % figure is the maximum permitted deflection in terms of % of free length.

TABLE I

| Selected Opening Pressure (p.s.i.) | Required Spring Preload (lbs.) |
|---|---|
| 50 | 30 |
| 100 | 60 |
| 150 | 90 |
| 200 | 120 |
| 500 | 300 |

TABLE II

| Spring Type & Cat. # | Free Length (Ins.) | Preloading (Lbs.) | Spring Constant (Lbs./Inch) | Pre-Load Deflection (Ins.) |
|---|---|---|---|---|
| A. 50% MP-44 | 2 | 30 | 233 | .13 |
| B. 50% MP-44 | 2 | 60 | 233 | .26 |
| C. 50% MP-44 | 2 | 90 | 233 | .386 |
| D. 37% MHP-44 | 2 | 90 | 367 | .245 |
| E. 37% MHP-44 | 2 | 120 | 367 | .327 |
| F. 30% HP-44 | 2 | 300 | 840 | .356 |

With reference to Table II the spring must not exhibit undue deflection at the calculated pre-loading. It can be seen that the MP-44 spring is quite adequate in situations A and B. In situations C and D either the MP-44 or MHP-44 spring will suffice. Conditions E and F further illustrate acceptable situations under high opening pressures. In general, the spring having the lowest spring constant should be chosen provided that the total deflection when the closure is full open does not exceed design specifications. If an overly heavy and stiff spring is used, excess pumping energy will be used, keeping in mind that all the drilling liquid pumped during drilling must pass through this valve assembly. If the ball starts to chatter or vibrate a different spring stiffness should be selected.

The operation of the wire line core barrel apparatus described above will be readily apparent to those skilled in the art.

The first step should be to set the spring pre-loading on the ball 108 thereby to provide the selected opening pressure. This is set manually and it can be tested by the fluid pump on the drill operator's workbench prior to going into the drill hole. Once this adjustment has been completed, the complete inner tube assembly is pumped down the drill string until the inner tube assembly reaches the fully landed position in the drill string with the landing shoulder of the latch body seated on the drill string landing shoulder. When this occurs, the flush pump in use must produce sufficient pressure to push the ball 108 down to allow the drilling liquid to pass through the latch body. Since the fluid pump must exert sufficient pressure as to overcome the pre-load force, there is an instant rise in the output pressure of the flush pump up to at least the selected opening pressure (which might for example be 150 p.s.i.) thus indicating that the inner tube assembly is properly landed. Since proper landing has been achieved, it is almost certain that the system is also properly latched and ready to go into operation. Thus, the present system does away with the rather inaccurate techniques used in the prior art to establish proper landing and latching of the inner tube assembly.

Once the drilling operation commences, the pressure gauge on the flush pump may for example register 300 p.s.i. (150 p.s.i. to force the drilling liquid through the valve closure in the bypass plus a further 150 p.s.i. to force the flushing liquid across the face of the bit with sufficient force as to flush or clean the cuttings away from the drill face). In the event that drilling liquid circulation is lost because of fissures in the rock formation, the reading on the pump pressure gauge will quickly drop to 150 p.s.i. because this is the preselected valve closure opening pressure. However, regardless of the lost circulation, the drill string will always remain sufficiently full of liquid as to greatly reduce the risk of burnt bits and stuck drill rods. The drill operator will know almost instantly that a fissure has been reached and in these conditions he can take action to alleviate the situation such as reducing the penetration rate and increasing the flow of drilling fluid in an effort to keep the cuttings moving up the drill bore to avoid burning of the bit and sticking of the rod. The advantages of the improvement described will hence be readily apparent to those skilled in this art.

A preferred embodiment of the invention has been described by way of example. However, the invention is not to be limited to the precise embodiment described but is to extend to the full range of equivalencies as encompassed by the appended claims.

We claim:

1. A wire line core barrel inner tube assembly capable of travelling longitudinally within a drill string toward and away from a drill bit carried on the lower end of the string, the drill string having an annular landing shoulder therein; said inner tube assembly comprising an elongated body having an annular landing shoulder adapted to co-operate with and seat on the landing shoulder of the drill string when in use, said body having a valve chamber defined therein and inlet and outlet ports leading from the valve chamber to the exterior of the body on opposite sides of said landing shoulder to define a by-pass passage through which drilling liquid passing along the drill string must flow on its way toward the bit in operation when the landing shoulder of said body is seated on the landing shoulder of the drill string, said valve chamber having a valve seat therein, a valve closure within the valve chamber and a biasing device urging the valve closure against the valve seat with a selected pre-loading force as to prevent flow of drilling liquid through the by-pass passage and toward the drill bit until the pressure differential across the valve closure is increased to a level sufficient to overcome the preloading force applied by the biasing device.

2. The assembly of claim 1 wherein said biasing device is arranged such that the differential pressure necessary to overcome the pre-loading force applied is not less than about 50 p.s.i.

3. The assembly of claim 1 wherein said biasing device is arranged such that the differential pressure necessary to overcome the pre-loading force applied is not less than about 100 p.s.i.

4. The assembly of claim 1 wherein said biasing device is arranged such that the differential pressure necessary to overcome the pre-loading force applied is not less than about 150 p.s.i. and not greater than about 500 p.s.i.

5. The assembly of claim 1 wherein said biasing device is arranged so that the differential pressure needed to open the closure is sufficient so that in the event the bit strikes a cavity or crevice in a formation being drilled resulting in loss of drilling liquid, at least a substantial head of drilling liquid will be retained in the drill string thereby to alleviate burning of the bit and sticking of the drill string owing to loss of drilling liquid circulation.

6. The assembly of claim 1 wherein said valve closure comprises a ball and the biasing device comprises a coil compression spring.

7. The assembly of claim 1 wherein said valve closure comprises a ball and the biasing device comprises a coil compression spring, said spring being mounted on and disposed about a threaded adjustment rod, the distal end of the rod serving as a stop to limit the degree of travel of the ball between full open and full closed positions, rotation of the rod serving to advance the rod axially toward and away from the valve seat to vary the pre-loading force.

8. The assembly of claim 1 wherein said body is a latch body carrying spring-loaded latches arranged to engage a latch seat in the drill string when the inner tube assembly reaches a fully landed position in the drill string with the landing shoulder of said body seated on the drill string landing shoulder, said biasing device being arranged so that the differential pressure necessary to overcome the pre-loading force causes a pressure rise at the surface detectable by a driller as soon as the fully landed condition is attained in consequence of which the driller knows that landing and latching have been achieved.

9. The assembly of claim 8 wherein said valve closure comprises a ball and the biasing device comprises a coil compression spring.

10. The assembly of claim 8 wherein said valve closure comprises a ball and the biasing device comprises a coil compression spring, said spring being mounted on and disposed about a threaded adjustment rod, the distal end of the rod serving as a stop to limit the degree of travel of the ball between full open and full closed positions, rotation of the rod serving to advance the rod axially toward and away from the valve seat to vary the pre-loading force.

11. A latch body for a wire line core barrel inner tube assembly, the latch body having an annular landing shoulder adapted to co-operate with and seat on a landing shoulder of a drill string when the inner tube assembly is correctly landed, the latch body having spring loaded latches mounted therein and adapted to engage a latch seat in a drill string upon correct landing, said latch body having a valve chamber defined therein and inlet and outlet ports leading from the valve chamber to the exterior of the latch body on opposite sides of said landing shoulder to define a by-pass passage through which drilling liquid passing along the drill string must flow on its way toward the bit in operation when the landing shoulder of said latch body is seated on the landing shoulder of the drill string, said valve chamber having a valve seat therein, a valve closure within the valve chamber and a biasing device urging the valve closure against the valve seat with a selected pre-loading force as to prevent flow of drilling liquid through the by-pass passage and toward the drill bit until the pressure differential across the valve closure is increased to a level sufficient to overcome the pre-loading force applied by the biasing device, said biasing device being arranged so that the differential pressure necessary to overcome the preloading force causes a pressure rise at the surface detectable by a driller when the fully landed condition is attained in consequence of which the driller knows that correct landing and latching have been achieved.

12. The latch body of claim 11 wherein said valve closure comprises a ball and the biasing device comprises a coil compression spring.

13. The latch body of claim 11 wherein said valve closure comprises a ball and the biasing device comprises a coil compression spring, said spring being mounted on and disposed about a threaded adjustment rod, the distal end of the rod serving as a stop to limit the degree of travel of the ball between full open and full closed positions, rotation of the rod serving to advance the rod axially toward and away from the valve seat to vary the pre-loading force.

14. A core drilling method including providing a wire line core barrel inner tube assembly capable of travelling longitudinally within a drill string toward and away from a drill bit carried on the lower end of the string, the drill string having an annular landing shoulder therein; said inner tube assembly comprising an elongated body having an annular landing shoulder adapted to co-operate with and seat on the landing shoulder of the drill string when in use, said body having a valve chamber defined therein and inlet and outlet ports leading from the valve chamber to the exterior of the body on opposite sides of said landing shoulder to define a by-pass passage through which drilling liquid passing along the drill string must flow on its way toward the bit in operation when the landing shoulder of said body is seated on the landing shoulder of the drill string, said valve chamber having a valve seat therein, a valve closure within the valve chamber and a biasing device urging the valve closure against the valve seat with a selected pre-loading force as to prevent flow of drilling liquid through the by-pass passage and toward the drill bit until the pressure differential across the valve closure is increased to a level sufficient to overcome the pre-loading force applied by the biasing device wherein said body is a latch body carrying spring-loaded latches arranged to engage a latch seat in the drill string when the inner tube assembly reaches a fully landed position in the drill string with the landing shoulder of said body seated on the drill string landing shoulder, said biasing device being arranged so that the differential pressure necessary to overcome the pre-loading force causes a pressure rise at the surface detectable by a driller as soon as the fully landed condition is attained in consequence of which the driller knows that landing and latching have been achieved and supplying drilling liquid to the drill string with the inner tube assembly being caused to travel along the drill string toward a landing position therein, monitoring the pressure of the drilling liquid being supplied to the drill string and detecting or noting a sudden rise in the liquid pressure as established by the pre-loading force of the biasing device whereby to confirm landing and latching of the assembly prior to commencement of the drilling operation.

15. In a drill string apparatus wherein a drill bit is secured to the distal end of the string and a drilling liquid is pumped along the interior of the string during drilling to cool the drill bit, flush cuttings away therefrom and lift the cuttings along the drill string toward the surface, the combination of a flow control device disposed within said drill string above the drill bit for maintaining a desired head of liquid in the drill string above the drill bit so that in the event the bit strikes a cavity or crevice in a formation being drilled resulting in loss of drilling liquid, at least a substantial head of drilling liquid will be retained in the drill string thereby to alleviate burning of the bit and sticking of the drill string owing the loss of drilling liquid circulation, and wherein said flow control device comprises a valve assembly including a control element and a spring which can be pre-loaded to resiliently bias the control element toward a closed flow-inhibiting condition, said valve assembly permitting the flow of drilling liquid toward the bit only after the drilling liquid is pressurized sufficiently to overcome the pre-loading applied by the spring to the control element.

16. The apparatus of claim 15 wherein said pre-loading is such that a pressure of at least about 50 pounds per square inch is needed to open the control element and permit flow of drilling fluid toward the drill bit.

17. The apparatus of claim 15 wherein said pre-loading is such that a pressure of at least 100 pounds per square inch is needed to open the control element and permit flow of drilling fluid toward the drill bit.

18. The apparatus of claim 15 wherein said valve assembly is disposed within a wire line core barrel assembly.

* * * * *